US007596332B2

(12) United States Patent
Noguchi et al.

(10) Patent No.: US 7,596,332 B2
(45) Date of Patent: Sep. 29, 2009

(54) FIXING APPARATUS AND IMAGE FORMING APPARATUS INCLUDING POWER SUPPRESSION

(75) Inventors: Tomoyuki Noguchi, Fukuoka (JP); Noboru Katakabe, Fukuoka (JP)

(73) Assignee: Panasonic Corporation, Osaka (JP)

( * ) Notice: Subject to any disclaimer, the term of this patent is extended or adjusted under 35 U.S.C. 154(b) by 251 days.

(21) Appl. No.: 10/598,437

(22) PCT Filed: Feb. 2, 2005

(86) PCT No.: PCT/JP2005/003186

§ 371 (c)(1),
(2), (4) Date: Aug. 30, 2006

(87) PCT Pub. No.: WO2005/085960

PCT Pub. Date: Sep. 15, 2005

(65) Prior Publication Data

US 2007/0166067 A1 Jul. 19, 2007

(30) Foreign Application Priority Data

Mar. 3, 2004 (JP) ..... 2004-059754

(51) Int. Cl.
*G03G 15/20* (2006.01)

(52) U.S. Cl. ..... 399/67

(58) Field of Classification Search ..... 399/67, 399/298, 33, 88

See application file for complete search history.

(56) References Cited

U.S. PATENT DOCUMENTS 5,475,194 A * 12/1995 Watanabe et al. ..... 219/216
6,564,025 B2 * 5/2003 Sameshima et al. ..... 399/68
2005/0041991 A1 2/2005 Ihara et al.
2005/0199613 A1 9/2005 Samei et al.

(Continued)

FOREIGN PATENT DOCUMENTS

JP 02081074 A * 3/1990

(Continued)

OTHER PUBLICATIONS

English Language Abstract of JP 2001-203072.

(Continued)

*Primary Examiner*—Quana M Grainger
(74) *Attorney, Agent, or Firm*—Greenblum & Bernstein P.L.C.

(57) ABSTRACT

A fixing device for reducing, without fail, the heating output without using a control circuit if an excessive temperature rise of a rotary heating member is predicted, even if the control circuit fails or runs away. In the fixing device, heating of a fixing belt for heat-fixing an unfixed image on a recording medium is controlled by a body-side processor. When the fixing belt stops or rotates at a rotational speed equal to or below a threshold, an oscillation stop circuit stops the oscillation of an inverter circuit to stop the heating, independently of the processor. To check the operation of a rotation detection circuit for detecting the rotating state of the fixing belt (fixing roller) and the oscillation stop circuit, self-diagnosis is utilized to ascertain that the fixing belt is not heated by giving a heating instruction when the condition of not heating the fixing belt is satisfied is performed when the power is turned on or is performed regularly during standby.

13 Claims, 10 Drawing Sheets

U.S. PATENT DOCUMENTS

| | | | | |
|---|---|---|---|---|
| 2005/0201768 | A1 | 9/2005 | Tatematsu et al. | |
| 2006/0159479 | A1 * | 7/2006 | Sugita et al. | 399/69 |

FOREIGN PATENT DOCUMENTS

| | | | | |
|---|---|---|---|---|
| JP | 03181980 | A | * | 8/1991 |
| JP | 05019653 | A | * | 1/1993 |
| JP | 07253733 | A | * | 10/1995 |
| JP | 2001-203072 | | | 7/2001 |
| JP | 2003-270982 | | | 9/2003 |
| JP | 2003-295644 | | | 10/2003 |
| JP | 2003-345195 | | | 12/2003 |
| JP | 2004013020 | A | * | 1/2004 |
| JP | 2004226492 | A | * | 8/2004 |

OTHER PUBLICATIONS

English language Abstract of JP 2003-345195.

* cited by examiner

FIXING APPARATUS AND IMAGE FORMING APPARATUS INCLUDING POWER SUPPRESSION

TECHNICAL FIELD

The present invention relates to a fixing apparatus that heat-fixes an unfixed image onto a recording material.

BACKGROUND ART

An image forming apparatus such as an electrophotographic copier, printer, or facsimile apparatus is equipped with a fixing apparatus that heat-fixes an unfixed toner image formed on the surface of a recording material. There is a fixing apparatus wherein a pressure nip is formed between a fixing roller and a heating roller pressing against that fixing roller, recording material bearing toner is gripped and transported to this pressure nip, and an unfixed image is heated from the fixing roller side and is heat-fixed onto the recording material surface.

A variety of methods have been developed as fixing roller heating methods. For example, a method is known whereby a fixing roller is composed of a film guide comprising an insulative cylindrical member that does not prevent the passage of magnetic flux and electromagnetic-induction heat-producing film (fixing film) wrapped around the outer periphery of this film guide, a magnetic field generated by a field generation section comprising an exciting coil and core provided outside the pressure nip area is applied and induction heating performed, and as the fixing roller rotates, the heated area moves to the pressure nip and heat-fixes the toner. Alternatively, a method is known whereby a fixing belt of electromagnetic-induction heat-producing film is suspended between a fixing roller and heating roller, the fixing belt is induction-heated by the application of a magnetic field to the fixing belt sliding over the heating roller by a field generation section provided opposite the heating roller, and the heated fixing belt moves to the pressure nip and heat-fixes the toner.

In both methods, a control circuit (microcomputer) generally performs temperature control in order to maintain the temperature of the rotating heating member (fixing film or fixing belt) at a temperature suitable for fixing. The control circuit not only controls the rotating heating member at the optimal temperature, but can also be given a control function of preventing the problem of erroneous heating when rotation of the rotating heating member stops. Specifically, a rotation detection section (optical sensor) is provided that detects rotation of the fixing film, and when rotation of the fixing film stops or falls to a predetermined speed or below, the control circuit (microcomputer) stops or suppresses the power supply to the exciting coil, and suppresses heat output (see Patent Document 1, for example).

Patent Document 1: Unexamined Japanese Patent Publication No. 2001-203072

DISCLOSURE OF INVENTION

Problems to be Solved by the Invention

However, if the control circuit (microcomputer) fails or malfunctions, heat output will not be suppressed, and therefore if an excessive rise in temperature of the rotating heating member is predicted, heat output must be suppressed without the intermediation of the control circuit.

It is an object of the present invention to provide a fixing apparatus that makes it possible to diagnose whether or not a mechanism that prevents an excessive rise in temperature of the rotating heating member when the control circuit is in a normal state operates normally, and to suppress heat output dependably without the intermediation of the control circuit if the control circuit fails or malfunctions, thereby producing an excellent effect on safety.

Means for Solving the Problems

According to a fixing apparatus of the present invention, in an entity whereby a processor on the main body side controls heating of a rotating heating member that heat-fixes an unfixed image on a recording medium, a self-diagnosis function is provided whereby, when a condition for not heating the rotating heating member has been met, a directive to heat is given, and it is confirmed that the rotating heating member is not heated.

Advantageous Effect of the Invention

According to the present invention, a fixing apparatus can be provided that makes it possible to diagnose whether or not a mechanism that prevents an excessive rise in temperature of the rotating heating member when the control circuit is in a normal state operates normally, and to dependably suppress heat output without the intermediation of the control circuit if the control circuit fails or malfunctions, thereby producing an excellent effect on safety

BEST MODE FOR CARRYING OUT THE INVENTION

Figure 1:
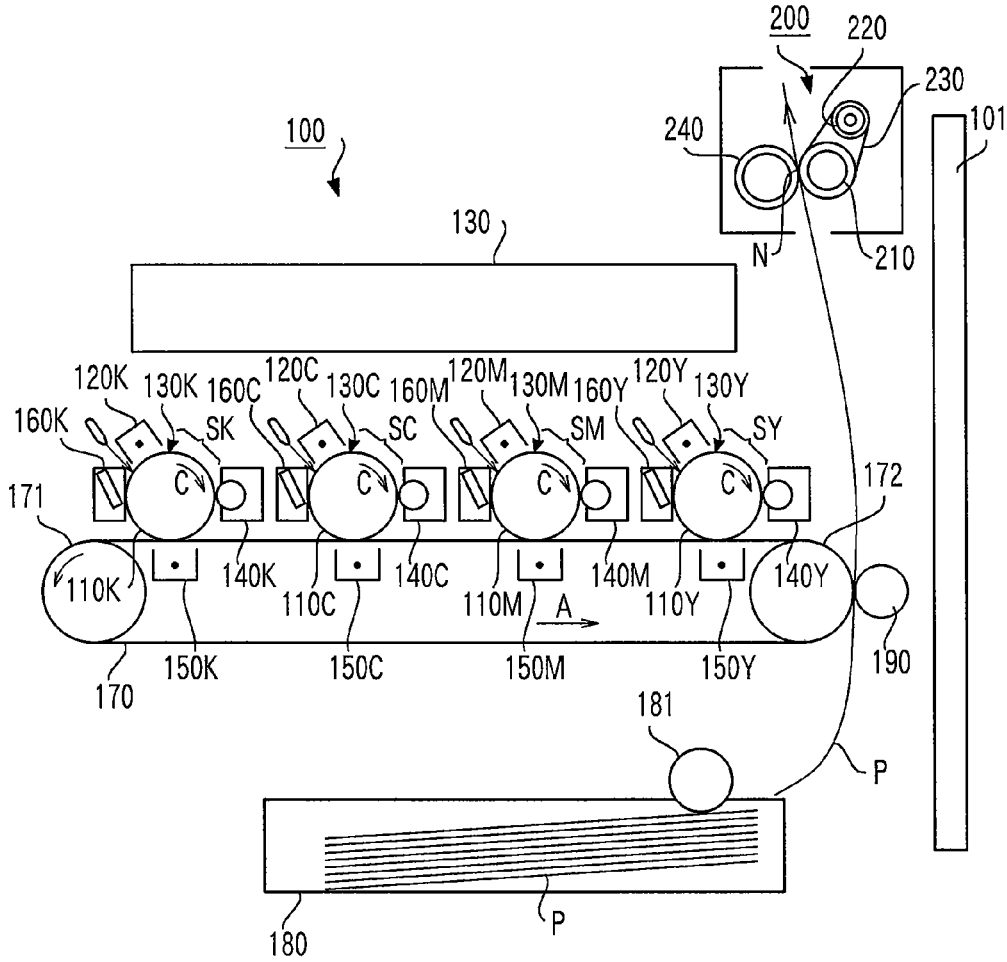
FIG. 1 is an overall configuration diagram of an image forming apparatus to which Embodiment 1 and Embodiment 2 of the present invention are applied.

Embodiments of the present invention will now be described in detail with reference to the accompanying drawings. In the drawings, configuration elements and equivalent parts that have identical configurations or functions are assigned the same codes, and descriptions thereof are not repeated.

EMBODIMENT 1

FIG. 1 is schematic cross-sectional diagram showing the configuration of an image forming apparatus suitable for the installation of a fixing apparatus according to Embodiment 1 of the present invention. As shown in FIG. 1, this image forming apparatus 100 is a single-path image forming apparatus in which toner images of four colors contributing to coloring of a color image are formed separately on four image bearing elements, these toner images of four colors are successively superimposed onto an intermediate transfer element as a primary transfer process, and then blanket transfer (secondary transfer) of this primary image to the recording medium is performed.

A fixing apparatus according to Embodiment 1 is not limited solely to the above-described single-path type of image forming apparatus, but can be installed in any type of image forming apparatus.

In FIG. 1, symbols Y, M, C, and K appended to the reference codes assigned to various configuration elements of image forming apparatus 100 indicate configuration elements involved in formation of a yellow image (Y), magenta image (M), cyan image (C), and black image (K), respectively, with configuration elements assigned the same reference code having a common configuration.

Image forming apparatus 100 has photosensitive drums 110Y, 110M, 110C, and 110K as the above-described four image bearing elements, and an intermediate transfer belt (intermediate transfer element) 170. Around photosensitive drums 110Y, 110M, 110C, and 110K are located image forming stations SY, SM, SC, and SK. Image forming stations SY, SM, SC, and SK comprise electrifiers 120Y, 120M, 120C, and 120K, an aligner (exposure apparatus) 130, developing units 140Y, 140M, 140C, and 140K, transfer units 150Y, 150M, 150C, and 150K, and cleaning apparatuses 160Y, 160M, 160C, and 160K.

In FIG. 1, photosensitive drums 110Y, 110M, 110C, and 110K are rotated in the direction indicated by arrows C. The surfaces of photosensitive drums 110Y, 110M, 110C, and 110K are uniformly charged to a predetermined potential by electrifiers 120Y, 120M, 120C, and 120K respectively.

The surfaces of charged photosensitive drums 110Y, 110M, 110C, and 110K are irradiated with laser beam scanning lines 130Y, 130M, 130C, and 130K corresponding to image data of specific colors by means of aligner 130. By this means, electrostatic latent images of the aforementioned specific colors are formed on the surfaces of photosensitive drums 110Y, 110M, 110C, and 110K.

The electrostatic latent images of each of the specific colors formed on photosensitive drums 110Y, 110M, 110C, and 110K are developed by developing units 140Y, 140M, 140C, and 140K. By this means, unfixed images of the four colors contributing to the coloring of the color image are formed on photosensitive drums 110Y, 110M, 110C, and 110K.

The developed toner images of four colors on photosensitive drums 110Y, 110M, 110C, and 110K undergo primary transfer to above-described endless intermediate transfer belt 170 functioning as an intermediate transfer element by means of transfer units 150Y, 150M, 150C, and 150K. By this means, the toner images of four colors formed on photosensitive drums 110Y, 110M, 110C, and 110K are successively superimposed, and a full-color image is formed on intermediate transfer belt 170.

After the toner images have been transferred to intermediate transfer belt 170, photosensitive drums 110Y, 110M, 110C, and 110K have residual toner remaining on their surfaces removed by cleaning apparatuses 160Y, 160M, 160C, and 160K, respectively.

Here, aligner 130 is installed at a predetermined angle with respect to photosensitive drums 110Y, 110M, 110C, and 110K. Also, intermediate transfer belt 170 is suspended between a drive roller 171 and driven roller 172, and is circulated in the direction indicated by arrow A in FIG. 1 by rotation of drive roller 171.

Meanwhile, at the bottom of image forming apparatus 100, a paper feed cassette 180 is provided in which recording paper P such as printing paper functioning as a recording medium is held. Recording paper P is fed out from paper feed cassette 180 by a paper feed roller 181 one sheet at a time into a predetermined sheet path.

When recording paper P fed into this sheet path passes through a transfer nip formed between the outer surface of intermediate transfer belt 170 suspended on driven roller 172 and a secondary transfer roller 190 in contact with the outer surface of intermediate transfer belt 170, the full-color image (unfixed image) formed on intermediate transfer belt 170 is blanket-transferred by secondary transfer roller 190.

Figure 2:
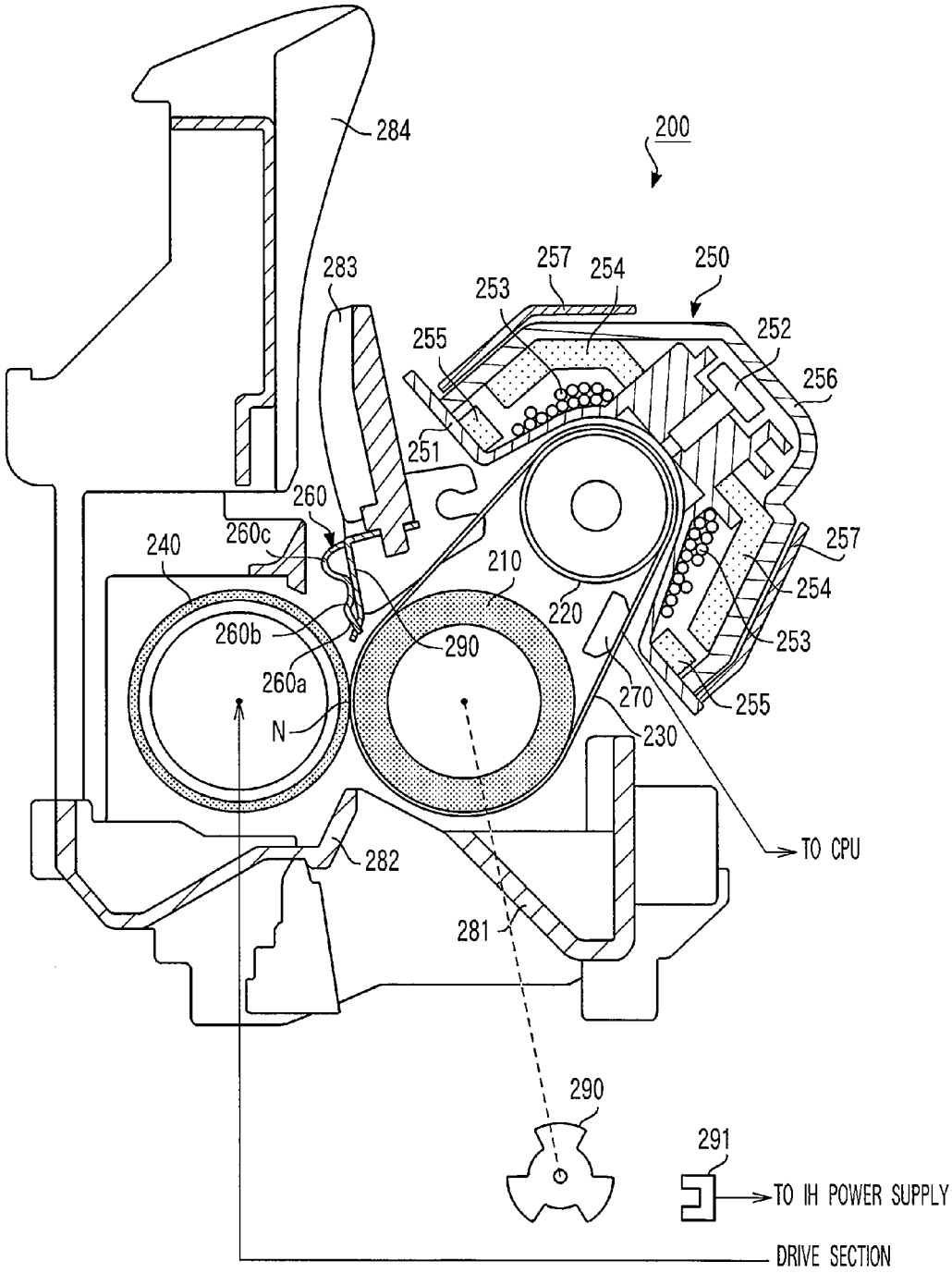
FIG. 2 is a cross-sectional side view of a fixing apparatus provided in the image forming apparatus shown in FIG. 1 according to Embodiment 1 of the present invention.

Recording paper P passes through a fixing nip N formed between the outer surface of a fixing belt 230 suspended between a fixing roller 210 and heating roller 220, and a pressure roller 240 in contact with the outer surface of fixing belt 230, in a fixing apparatus 200 shown in detail in FIG. 2. By this means, the unfixed full-color image blanket-transferred to recording paper P is heat-fixed onto recording paper P.

Image forming apparatus 100 is equipped with a freely opening and closing door 101 forming part of the housing of image forming apparatus 100, and replacement or maintenance of fixing apparatus 200, handling of recording paper P jammed in the above-described paper transportation path, and so forth, can be carried out by opening and closing this door 101.

Next, fixing apparatus 200 according to Embodiment 1 installed in image forming apparatus 100 will be described with reference to FIG. 2.

Fixing apparatus 200 according to Embodiment 1 is an induction heating (IH) type of fixing apparatus, and, as shown in FIG. 2, is equipped with fixing roller 210, heating roller 220 as a heat-producing element, fixing belt 230 as an image heating element, pressure roller 240, an induction heating apparatus 250 as a heating section, a separator 260 as a sheet separation guide plate, sheet guide plates 281, 282, 283, and 284 as sheet transportation path forming members, and so forth.

In this fixing apparatus 200, heating roller 220 and fixing belt 230 are heated through the agency of a magnetic field generated by induction heating apparatus 250, and an unfixed image on recording paper P transported along sheet guide plates 281, 282, 283, and 284 is heat-fixed by fixing nip N between heated fixing belt 230 and pressure roller 240.

A fixing apparatus according to this embodiment may also be configured so that fixing belt 230 is not used, fixing roller 210 also serves as heating roller 220, and an unfixed image on recording paper P is heat-fixed directly by this fixing roller 210. It also goes without saying that a heat source such as a halogen lamp may be used as the heating section.

In FIG. 2, heating roller 220 functioning as a heat-producing element is configured as a rotating element comprising a hollow cylindrical magnetic metallic member of iron, cobalt, nickel, or an alloy of these metals, for example, with both ends supported in rotatable fashion by bearings fixed to supporting side plates (not shown), and rotated by a drive section (not shown). Heating roller 220 has a configuration enabling a rapid rise in temperature with low thermal capacity, with an external diameter of 20 mm and thickness of 0.3 mm, and is regulated so that its Curie point is 300° C. or above.

Fixing roller 210 is configured with, for example, a core of stainless steel or another metal covered by a heat-resistant elastic member of solid or foam silicone rubber, and has an outer diameter of about 30 mm, larger than the outer diameter of heating roller 220. The elastic member has a thickness of about 3 to 8 mm and hardness of about 15 to 50° (Asker hardness: 6 to 25° JIS A hardness).

Pressure roller 240 presses against fixing roller 210. Due to the pressure between fixing roller 210 and pressure roller 240, a fixing nip N of predetermined width is formed at the pressure location.

Fixing belt 230 is configured as a heat-resistant belt suspended between heating roller 220 and fixing roller 210. Due to induction heating of heating roller 220 by induction heating apparatus 250 described later herein, the heat of heating roller 220 is transferred at the area of contact between fixing belt 230 and heating roller 220, and fixing belt 230 is heated all around due to its circulation.

In fixing apparatus 200 configured in this way, the thermal capacity of heating roller 220 is smaller than the thermal capacity of fixing roller 210, and therefore heating roller 220 is heated rapidly, and the warm-up time at the start of heat-fixing is shortened.

Fixing belt 230 is configured, for example, as a heat-resistant belt of multilayered construction, comprising a heat-producing layer, an elastic layer, and a release layer. The heat-producing layer has a magnetic metal such as iron, cobalt, nickel, or the like, or an alloy of these metals, as the base material. The elastic layer is of silicone rubber, fluororubber, or the like, fitted around the surface of the heat-producing layer. The release layer is formed of resin or rubber with good release characteristics, such as PTFE, PFY, FEP, silicone rubber, fluororubber, or the like, alone or mixed.

Even if foreign matter should be introduced between this fixing belt 230 and heating roller 220 for some reason, creating a gap, the fixing belt itself can still be heated by induction heating of its heat-producing layer by induction heating apparatus 250. Thus, this fixing belt 230 can itself be heated directly by induction heating apparatus 250, heating efficiency is good, and response is rapid, so that there is little unevenness of temperature, and reliability as a heat-fixing section is high.

Pressure roller 240 is configured with an elastic member of high heat resistance and high toner releasability fitted to the surface of a core comprising a cylindrical member of a highly heat conductive metal such as copper or aluminum, for example. Apart from the above-mentioned metals, SUS may also be used for the core.

This pressure roller 240 forms fixing nip N that grips and transports recording paper P by exerting pressure on fixing roller 210 via fixing belt 230. In this fixing apparatus 200 according to Embodiment 1, the hardness of pressure roller 240 is greater than the hardness of fixing roller 210, and fixing nip N is formed by the peripheral surface of pressure roller 240 biting into the peripheral surface of fixing roller 210 via fixing belt 230.

For this reason, pressure roller 240 has an external diameter of about 30 mm, the same as fixing roller 210, a thickness of about 2 to 5 mm, thinner than fixing roller 210, and hardness of about 20 to 60° (Asker hardness: 6 to 25° JIS A hardness), harder than fixing roller 210.

In fixing apparatus 200 with this kind of configuration, recording paper P is gripped and transported by fixing nip N so as to follow the surface shape of the peripheral surface of pressure roller 240, with the resultant effect that the heat-fixing surface of recording paper P separates easily from the surface of fixing belt 230.

A temperature detector 270 comprising a thermistor or similar heat-sensitive element with high thermal responsiveness is located in direct contact with the inner peripheral surface of fixing belt 230 in the vicinity of the entry side of fixing nip N. In this fixing apparatus 200, the heating temperature of heating roller 220 and fixing belt 230 due to induction heating apparatus 250 is controlled so that the surface temperature of fixing belt 230—that is, the unfixed image heat-fixing temperature—is maintained at a predetermined temperature based on the temperature of the inner peripheral surface of fixing belt 230 detected by temperature detector 270.

Next, the configuration of induction heating apparatus 250 will be described. As shown in FIG. 2, induction heating apparatus 250 is located so as to face the outer peripheral surface of heating roller 220 via fixing belt 230. Induction heating apparatus 250 is provided with a supporting frame 251 as a coil guide member of fire-retardant resin, curved so as to cover heating roller 220.

In the center part of supporting frame 251, a thermostat 252 is installed so that its temperature detecting part is partially expressed from supporting frame 251 toward heating roller 220 and fixing belt 230. Thermostat 252 detects the temperature of heating roller 220 and fixing belt 230, and if thermostat 252 detects that the temperature of heating roller 220 and fixing belt 230 is abnormally high, it forcibly breaks the connection between an exciting coil 253 functioning as a magnetic field generation section wound around the outer peripheral surface of supporting frame 251 and an inverter circuit (not shown).

Exciting coil 253 is configured with a long single exciting coil wire with an insulated surface wound alternately in the axial direction of heating roller 220 along supporting frame 251. The length of the wound part of this exciting coil 253 is set so as to be approximately the same as the length of the area of contact between fixing belt 230 and heating roller 220.

Exciting coil 253 is connected to an inverter circuit (not shown), and generates an alternating field by being supplied with a high-frequency alternating current of 10 kHz to 1 MHz (preferably, 20 kHz to 800 kHz). This alternating field acts upon the heat-producing layers of heating roller 220 and fixing belt 230 in the area of contact between heating roller 220 and fixing belt 230 and its vicinity. Through the agency of this alternating field, an eddy current with a direction preventing variation of the alternating field flows within these heat-producing layers.

This eddy current generates Joule heat corresponding to the resistance of the heating roller 220 and fixing belt 230 heat-producing layers, and causes induction heating of heating roller 220 and fixing belt 230 mainly in the area of contact between heating roller 220 and fixing belt 230 and its vicinity.

On the other hand, an arch core 254 and side core 255 are fitted on supporting frame 251 so as to surround exciting coil 253. Arch core 254 and side core 255 increase the inductance of exciting coil 253 and provide good electromagnetic coupling of exciting coil 253 and heating roller 220. Therefore, in this fixing apparatus 200, it is possible to apply a larger amount of power to heating roller 220 with the same coil current through the agency of arch core 254 and side core 255, enabling the warm-up time to be shortened.

Supporting frame 251 is also provided with a resin housing 256 formed in the shape of a roof so as to cover arch core 254 and thermostat 252 inside induction heating apparatus 250. A plurality of heat release vents are formed in this housing 256, allowing heat generated by supporting frame 251, exciting coil 253, arch core 254, and so forth, to be released externally. Housing 256 may be formed of a material other than resin, such as aluminum, for example.

Supporting frame 251 is also fitted with a short ring 257 that covers the outer surface of housing 256 to prevent blockage of the heat release vents formed in housing 256. Short ring 257 is located on the rear of arch core 254. Through the generation of an eddy current in the direction in which slight leakage flux leaked externally from the rear of arch core 254 is canceled out, short ring 257 has the effect of generating a magnetic field that cancels out the magnetic field of that leakage flux, and preventing unwanted emission due to that leakage flux.

A rotary encoder 290 is installed coaxially with respect to the rotation axis of fixing roller 210. A photointerrupter 291 is installed with its light-emitting section and light-receiving section positioned on opposite sides of the rotating blades of rotary encoder 290. As rotary encoder 290 is installed coaxially with respect to the rotation axis of fixing roller 210, it rotates integrally with fixing roller 210. During rotation of rotary encoder 290, the output signal of photointerrupter 291 is a square-wave phase signal in which the signal level rises each time a rotating blade of rotary encoder 290 cuts off a light beam that is emitted from the light-emitting section and strikes the light-receiving section. That is to say, photointerrupter 291 outputs a phase signal that has a period corresponding to the rotation speed of rotary encoder 290, and takes on a flat signal waveform when rotation of rotary encoder 290 stops.

Figure 3:
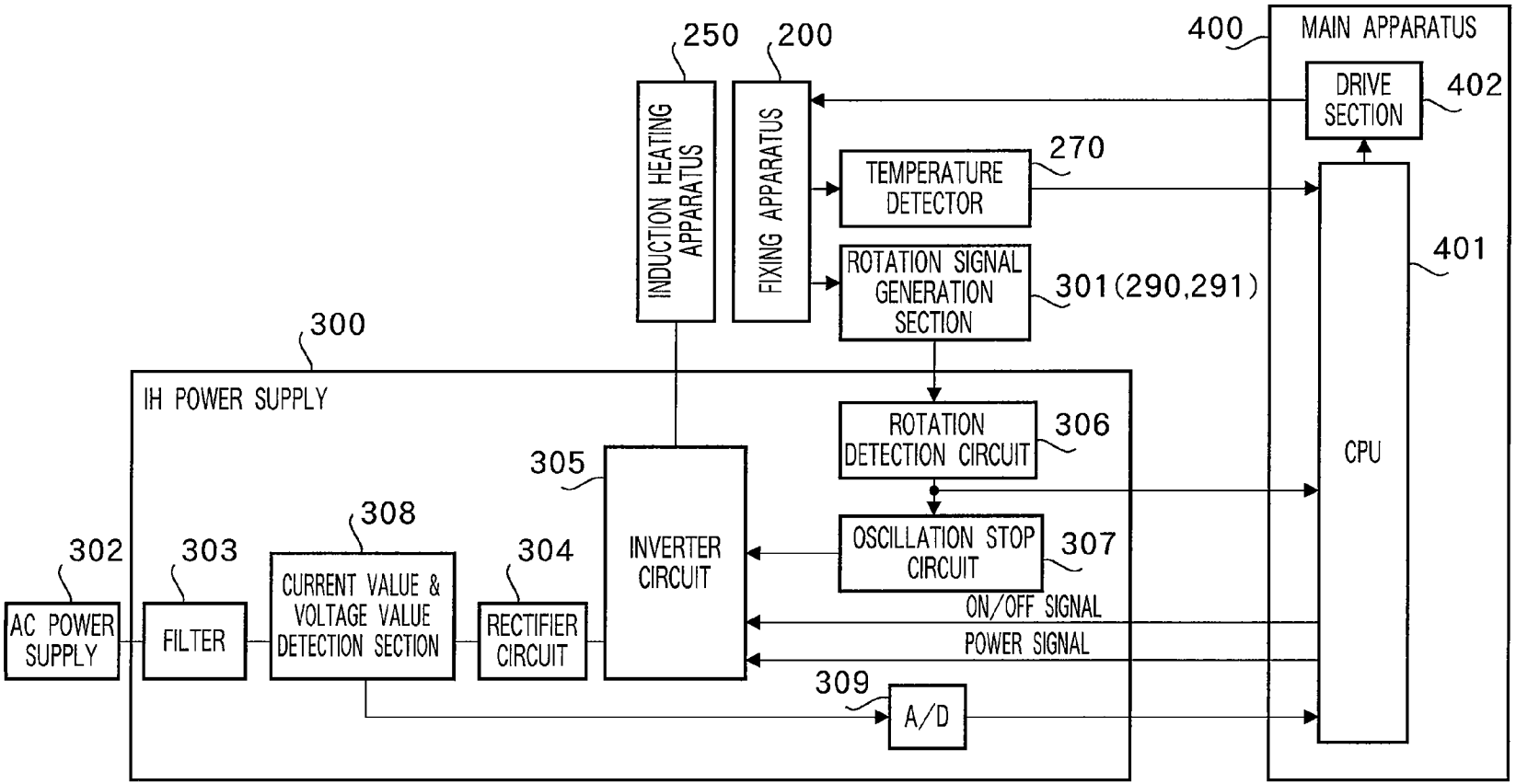
FIG. 3 is a functional block diagram of a fixing apparatus according to Embodiment 1 of the present invention.

Next, the electrical configuration and function of parts that control the operation of induction heating apparatus 250 will be described. FIG. 3 is a functional block diagram showing parts related to fixing apparatus 200, comprising an IH power supply 300 that controls the operation of induction heating apparatus 250 and a main apparatus 400 of an image forming apparatus.

In IH power supply 300, a commercial AC power supply 302 is connected to a rectifier circuit 304 via a filter 303, and alternating current (AC) is converted to direct current (DC). The DC side of rectifier circuit 304 is connected to an inverter circuit 305, and a high-frequency alternating current is supplied to induction heating apparatus 250 from inverter circuit Meanwhile, a phase signal output from a rotation signal generation section 301 comprising rotary encoder 290 and photointerrupter 291 is captured by a rotation detection circuit 306. A rotation detection signal output by rotation detection circuit 306 is input to an oscillation stop circuit 307, and when rotation of fixing roller 210 (fixing belt 230) is detected to have stopped or to have fallen to a predetermined rotation speed or below, oscillation of inverter circuit 305 is forcibly stopped. The rotation detection signal output by rotation detection circuit 306 is also input to a CPU 401 of main apparatus 400.

For purposes of self-diagnosis described later herein, a detection section 308 is also provided that detects the voltage value and current value supplied to rectifier circuit 304 from commercial AC power supply 302. A detection signal output by detection section 308 is converted to a digital signal by an A/D converter 309, and is then input to CPU 401 of main apparatus 400.

When power is turned on, and at regular intervals during standby, CPU 401 of main apparatus 400 performs self-diagnosis to confirm that fixing roller 210 is not heated when stopped or when rotating at a predetermined rotation speed or below. A drive section 402 of main apparatus 400 has the function of rotating pressure roller 240 on receiving a drive request from CPU 401.

Figure 4:
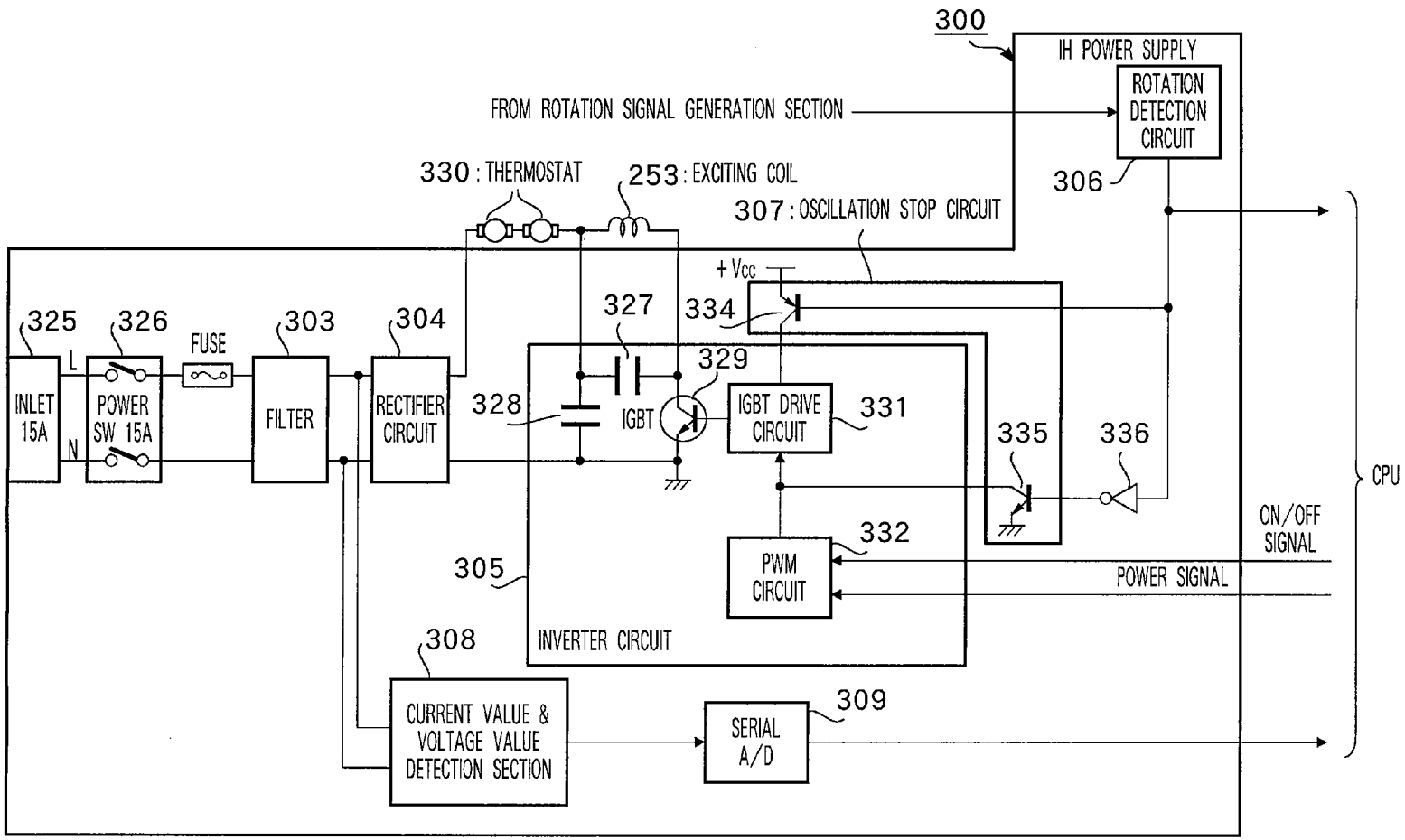
FIG. 4 is a circuit configuration diagram of an IH power supply provided in the fixing apparatus shown in FIG. 3 according to Embodiment 1 of the present invention.

FIG. 4 is a drawing showing the circuit configuration of IH power supply 300.

A power supply switch 326 is provided between an inlet 325 that is physically connected to commercial AC power supply 302, and filter 303. When power supply switch 326 is turned on, alternating current flows from commercial AC power supply 302 to rectifier circuit 304. In inverter circuit 305, a capacitor 327 is connected in parallel to exciting coil 253, one electrode of capacitor 327 is grounded via another capacitor 328, and the other electrode of capacitor 327 is grounded via a switching element 329 comprising an IGBT in the forward direction. DC-side terminals of rectifier circuit 304 are connected to both ends of exciting coil 253, and a high-frequency alternating current can be supplied to exciting coil 253 by switching element 329 on and off. Also, a thermostat 330 is inserted in series between a positive-electrode-side terminal of rectifier circuit 304 and exciting coil 253.

Switching element 329 has its gate electrode driven on and off by an IGBT drive circuit 331. IGBT drive circuit 331 controls the on/off drive period (the width of the on period and the width of the off period) by sending switching element 329 a square-wave PWM signal supplied from a PWM circuit 332. In a high-level period of IGBT drive circuit 331 output, switching element 329 is turned on and alternating current flows in exciting coil 253. In a low-level period, switching element 329 is turned off and the coil current flowing in exciting coil 253 falls abruptly. PWM circuit 332 outputs a PWM signal composed of pulses when an ON/OFF signal supplied from CPU 401 is ON, and stops pulse output when the ON/OFF signal is OFF. When the level of a power signal supplied from CPU 401 is high, the high-level period of the PWM signal is lengthened, and conversely, when the level of a power signal is low, the high-level period of the PWM signal is shortened. Varying the length of the high-level period of the PWM signal enables the size of the coil current flowing in exciting coil 253 to be varied, and the strength of the generated field to be varied, making it possible to vary the calorific value of heating roller 220 and fixing belt 230.

Oscillation stop circuit 307 is composed of a first transistor 334 and a second transistor 335. First transistor 334, IGBT drive circuit 331 and second transistor 335 are connected in series between +Vcc and ground, the collector side of first transistor 334 is maintained at +Vcc potential, and the emitter side of second transistor 335 is connected to ground potential. IGBT drive circuit 331 is configured so as to generate switching element 329 drive pulses using voltage Vcc applied via first transistor 334. Meanwhile, the output signal from rotation detection circuit 306 is applied to the base of first transistor 334, and the output signal from rotation detection circuit 306 is inverted by an inverter circuit 336 and then applied to the base of second transistor 335. Thus, while the output signal from rotation detection circuit 306 is active (while fixing roller 210 is rotating steadily), the base of first transistor 334 is in a conducting state, and the base of second transistor 335 is in a non-conducting state, and therefore operating voltage Vcc is applied to IGBT drive circuit 331. Conversely, while the output signal from rotation detection circuit 306 is non-active (while fixing roller 210 is stopped or is at a predetermined speed or below), the base of first transistor 334 is in a non-conducting state, and the base of second transistor 335 is in a conducting state, and therefore operating voltage Vcc ceases to be applied to IGBT drive circuit 331, and the PWM signal output from PWM circuit 332 ceases to be input.

Figure 5:
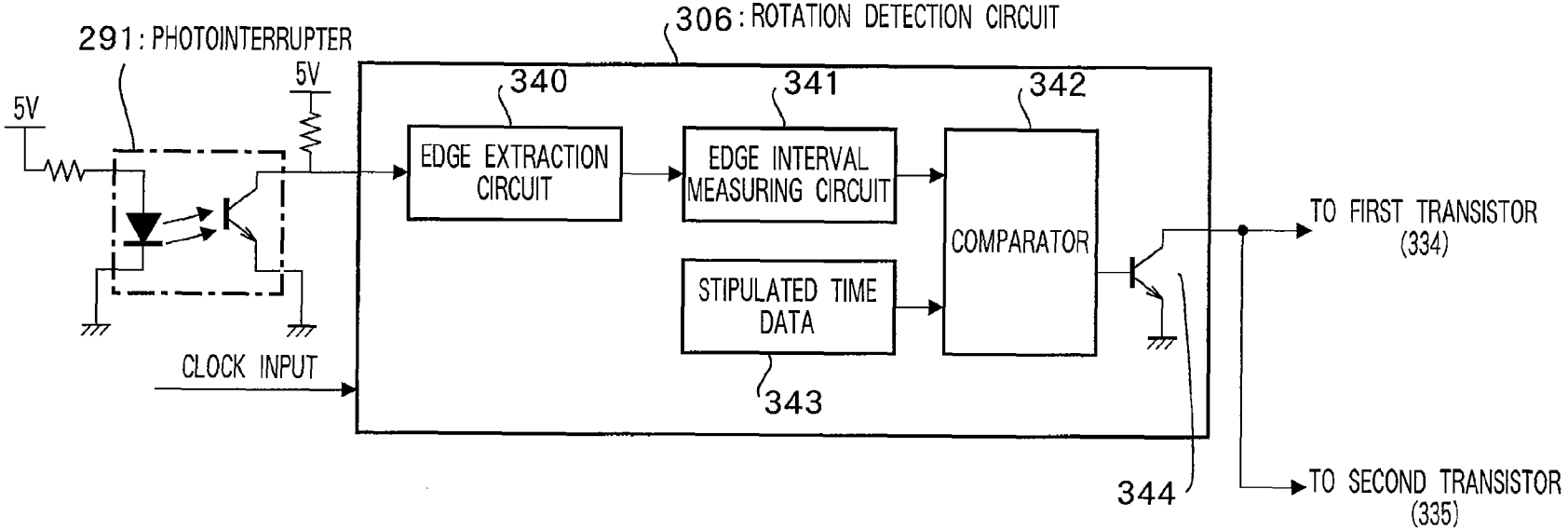
FIG. 5 is a circuit configuration diagram of a rotation detection circuit provided in the IH power supply shown in FIG. 4 according to Embodiment 1 of the present invention.

FIG. 5 is a drawing showing the actual configuration of rotation detection circuit 306. For the sake of explanation, the configuration of the parts connected before and after rotation detection circuit 306 is also shown in the drawing. In rotation detection circuit 306, a phase signal from photointerrupter 291 is input to an edge extraction circuit 340. The phase signal from photointerrupter 291 has a square-wave signal waveform while rotary encoder 290 is rotating, and has a flat signal waveform maintained at a low level or high level when rotation of rotary encoder 290 is stopped as described above. The period of the phase signal has a larger value as the rotation speed of rotary encoder 290 falls. Edge extraction circuit 340 extracts (rising or falling) edges of a phase signal output from photointerrupter 291, and an edge interval measuring circuit 341 measures the edge interval detected by edge extraction circuit 340—that is, the period of the phase signal. To be specific, edge interval measuring circuit 341 counts the number of clocks from detection of one edge until detection of the next edge, and inputs a count value indicating the edge interval (period) to a comparator 342. Meanwhile, a numeric value corresponding to an arbitrary rotation speed of fixing roller 210 is stored in a stipulated time data storage section 343. In this example, a numeric value is stored that corresponds to the period of a phase signal output from photointerrupter 291 when the rotation speed of fixing roller 210 is a value at which heating should be suppressed. Comparator 342 compares the count value output by edge interval measuring circuit 341 with the numeric value stored in stipulated time data storage section 343, and outputs a non-active drive signal while the count value exceeds the stored value, and an active drive signal while the count value is less than the stored value. The drive signal is applied to the base of a driver 344 comprising a transistor. Driver 344 generates a rotation detection signal that is low-level while the drive signal is non-active (while the count value exceeds the stored value), and high-level while the drive signal is active (while the count value is less than the stored value). Rotation detection circuit 306 shown here is configured as a digital circuit, but the same kind of function may also be implemented using an analog circuit.

Next, the operation of fixing apparatus 200 configured as described above will be described.

A fixing roller 210 rotation directive is issued from CPU 401 of main apparatus 400 to drive section 402. Drive section 402 performs normal rotation of pressure roller 240 by controlling a drive system (not shown). Fixing roller 210 pressed against pressure roller 240 is rotated together. Fixing roller 210 and heating roller 220 rotate in synchronization via fixing belt 230.

At this time, rotary encoder 290 installed coaxially with respect to the rotation axis of fixing roller 210 also rotates in synchronization. Through the rotation of rotary encoder 290, a phase signal with a period corresponding to the rotation speed of fixing roller 210 is output from photointerrupter 291. Rotation detection circuit 306 outputs a low-level signal until the rotation speed of fixing roller 210 reaches a predetermined value, and changes the signal to a high-level signal when the rotation speed exceeds the predetermined value. When the rotation detection signal from rotation detection circuit 306 becomes high-level, first and second transistors 334 and 335 of oscillation stop circuit 307 go to the on state. As a result, inverter circuit 305 goes to a state in which oscillation is possible in accordance with the output signal from PWM circuit 332.

When the need for heating by induction heating apparatus 250 arises, CPU 401 starts supplying an ON/OFF signal and power signal to inverter circuit 305 of IH power supply 300. PWM circuit 332 generates a pulsed PWM signal based on the ON/OFF signal and power signal, and supplies this PWM signal to IGBT drive circuit 331. IGBT drive circuit 331 sends the PWM signal to switching element 329 and performs on/off control. As a result, a high-frequency alternating current is supplied to exciting coil 253 of induction heating apparatus 250.

In induction heating apparatus 250, an alternating field generated by exciting coil 253 causes an eddy current to flow in the heat-producing layers of heating roller 220 and fixing belt 230, and induction heating of heating roller 220 and fixing belt 230 is performed mainly in the area of contact between heating roller 220 and fixing belt 230 and its vicinity.

Control during a rise in temperature of fixing belt 230 (in the period from the start of heating until the target temperature is reached) will now be described. When fixing belt 230 rises in temperature, in order to shorten the time taken to reach the target temperature as much as possible, CPU 401 controls the level of the ON/OFF signal and power signal so that the power supplied to IH power supply 300 is maintained at the highest level that can be supplied. That is to say, the current value and voltage value supplied to IH power supply 300 are detected by detection section 308, and a detection signal is input to CPU 401 by A/D converter 309. CPU 401 controls the level of the power signal based on the detected current value and voltage value so that the supply of predetermined power to IH power supply 300 is maintained. Power is controlled by means of this kind of feedback control.

Next, control during fixing belt 230 temperature regulation (in the period in which the target temperature is maintained) will be described.

The temperature of fixing belt 230 is detected by temperature detector 270. A temperature detection signal output by temperature detector 270 is input to CPU 401. CPU 401 determines the ON/OFF signal and power signal that should be output to PWM circuit 332 based on the relevant temperature detection signal. That is to say, the ON period and OFF period of the ON/OFF signal and the level of the power signal are controlled so that the target temperature is achieved. Basically, the fixing temperature is controlled by means of this kind of feedback control.

However, there is a possibility of the above-described feedback control not working if CPU 401 fails or malfunctions. If control becomes impossible after CPU 401 has issued a heating oriented directive to PWM circuit 332, induction heating apparatus 250 will continue heating. In particular, if the drive system of pressure roller 240, fixing roller 210, and heating roller 220 stops when induction heating apparatus 250 is performing heating, an area that continues to be heated directly by induction heating apparatus 250 will be damaged due to overheating, and it is therefore necessary to perform emergency stopping of heating by induction heating apparatus 250.

In a case such as this, in this embodiment, oscillation of inverter circuit 305 is halted and emergency stopping of heating by induction heating apparatus 250 is performed forcibly, without the intermediation of CPU 401, through the operation of oscillation stop circuit 307. That is to say, stopping of rotation of fixing roller 210 is detected directly by rotation signal generation section 301. At the point at which the rotation speed detected by rotation signal generation section 301 falls to a predetermined value, rotation detection circuit 306 changes the signal level of the rotation detection signal to the low level. As a result, first and second transistors 334 and 335 of oscillation stop circuit 307 go to the off state, and the supply of operating voltage Vcc and the PWM signal to IGBT drive circuit 331 is stopped. As a result, switching operations by switching element 329 stop, and therefore oscillation of inverter circuit 305 stops, and a high-frequency alternating current ceases to be supplied to exciting coil 253. Exciting coil 253 ceases to generate an alternating field, and therefore induction heating also stops.

As inverter circuit 305 oscillation is forcibly stopped without the intermediation of CPU 401 in this way when the rotation speed detected by rotation signal generation section 301 is at or below a predetermined value, even if CPU 401 fails or malfunctions, heat output can be dependably suppressed without the intermediation of CPU 401 if an excessive rise in temperature of the fixing belt is predicted.

The kind of function described above is only effectuated when the detection system that detects the rotation speed (rotation detection circuit 306 and so forth) and oscillation stop circuit 307 are operating normally. It is therefore desirable for self-diagnosis of these functions to be carried out before operation of induction heating apparatus 250 and so forth is performed. In Embodiment 1, the configuration provides for CPU 401 to perform self-diagnosis each time power is turned on and/or the system is restored from the sleep state, and/or at regular intervals during standby.

Figure 6:
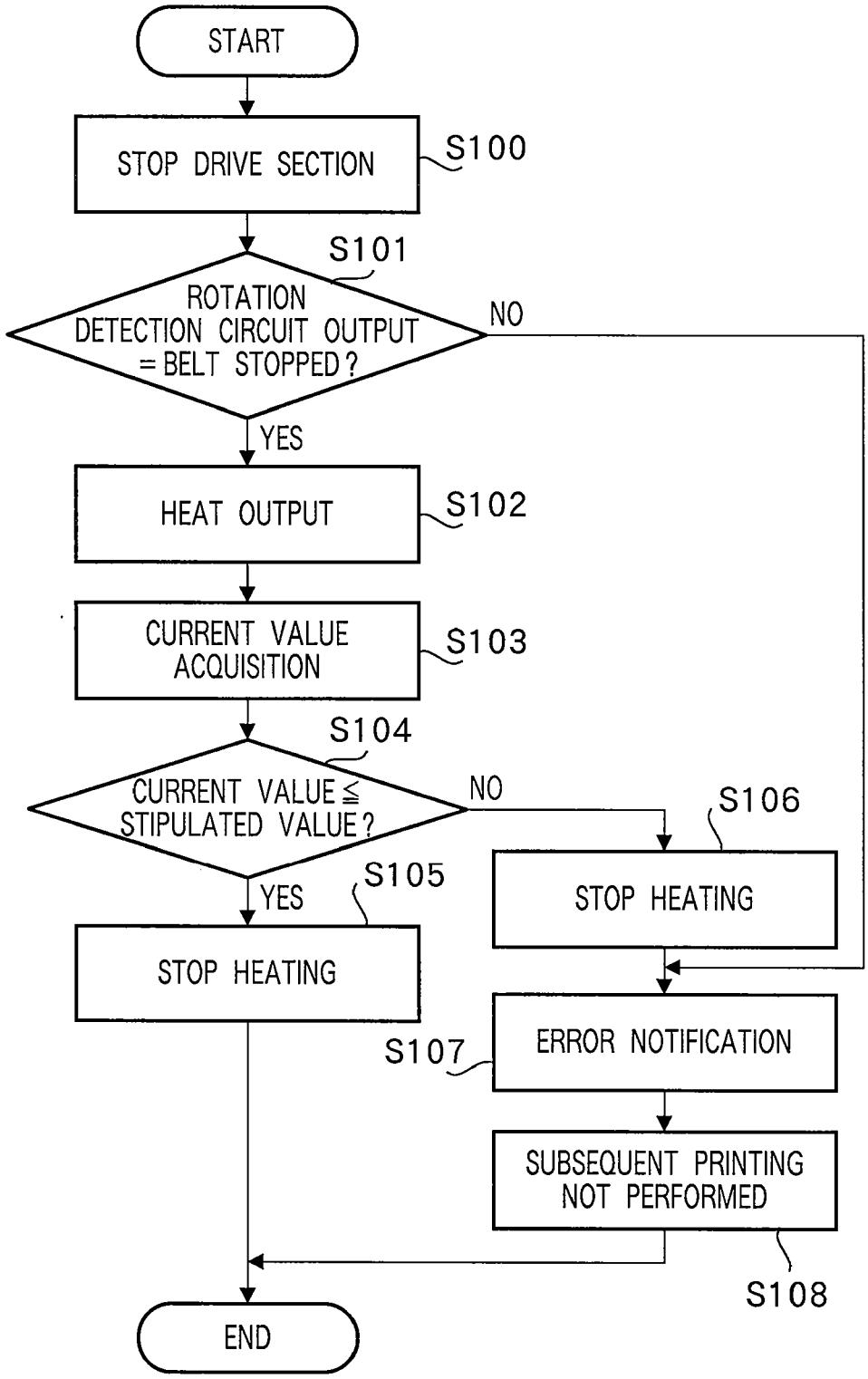
FIG. 6 is a flowchart for self-diagnosis of a fixing apparatus according to Embodiment 1 of the present invention.

FIG. 6 is a flowchart for self-diagnosis performed by CPU 401. This self-diagnosis is performed when power is turned on and/or at regular intervals during standby. When self-diagnosis is started, CPU 401 issues a stop command to drive section 402, and stops driving of pressure roller 240 (S100). After driving of pressure roller 240 is stopped and rotation of fixing roller 210 is stopped, a rotation detection signal output by rotation detection circuit 306 is captured, and it is determined whether or not fixing belt 230 (fixing roller 210) has stopped (S101). If the rotation detection signal is low-level, this indicates that the rotation speed of fixing roller 210 is at or below a predetermined value, but is here treated as indicating that rotation of fixing belt 230 has stopped. If rotation of fixing belt 230 is determined to have stopped (S101: YES), CPU 401 gives a directive for heat output to inverter circuit 305 by sending an ON/OFF signal and power signal to PWM circuit 332 (S102) That is to say, a heating directive is given when a condition for not heating fixing belt 230 has been met.

Here, if rotation detection circuit 306 and oscillation stop circuit 307 are operating normally, a state should be in effect in which operating voltage Vcc and a PWM signal are not input to IGBT drive circuit 331. Therefore, since oscillation of inverter circuit 305 has stopped, the current flowing from rectifier circuit 304 to inverter circuit 305 becomes a stipulated value or less.

CPU 401 captures a detection signal from detection section 308 (S103), and determines whether or not the current value indicated by the detection signal is less than or equal to the stipulated value (S104). If the current value is less than or equal to the stipulated value (S104: YES), this means that rotation detection circuit 306 and oscillation stop circuit 307 are operating normally. Therefore, in this case, CPU 401 determines that the results of the self-diagnosis are normal, and stops transmission of the ON/OFF signal and power signal being output to PWM circuit 332 (S105).

On the other hand, if the current value is greater than the stipulated value (S104: NO), this means that oscillation stop circuit 307 is not operating normally and oscillation of inverter circuit 305 has not stopped. In this case, CPU 401 immediately stops heating by stopping transmission of the ON/OFF signal and power signal being output to PWM circuit 332 (S106), and executes error notification processing (S107). For example, a message indicating that a failure has occurred may be displayed on an operation panel (not shown). Then CPU 401 performs control so that no subsequent printing (heating) is performed (S108). Alternatively, a warning voice message may be issued.

If CPU 401 determines in the processing in step S101 that the rotation detection signal does not indicate that fixing belt 230 has stopped (S101: NO), this means that rotation detection circuit 306 has detected rotation even though rotation of pressure roller 240 and so forth has stopped, indicating that a failure has occurred in rotation detection circuit 306 or rotation signal generation section 301. In this case, also, CPU 401 gives an error notification (S107) and performs control so that no subsequent printing (heating) is performed (S108).

By thus performing diagnosis of oscillation stop circuit 307 and rotation detection circuit 306 that stop oscillation of inverter circuit 305 dependably even if CPU 401 fails, the reliability of fixing apparatus 200 can be further increased.

Embodiment 2

Next, a fixing apparatus according to Embodiment 2 will be described. In Embodiment 2, a power-supply-side CPU is incorporated in the IH power supply, and rotation detection circuit and oscillation stop circuit functions are implemented by the power-supply-side CPU. An image forming apparatus to which this fixing apparatus is applied may be the above-described apparatus shown in FIG. 1 and FIG. 2, or may be of another type.

Figure 7:
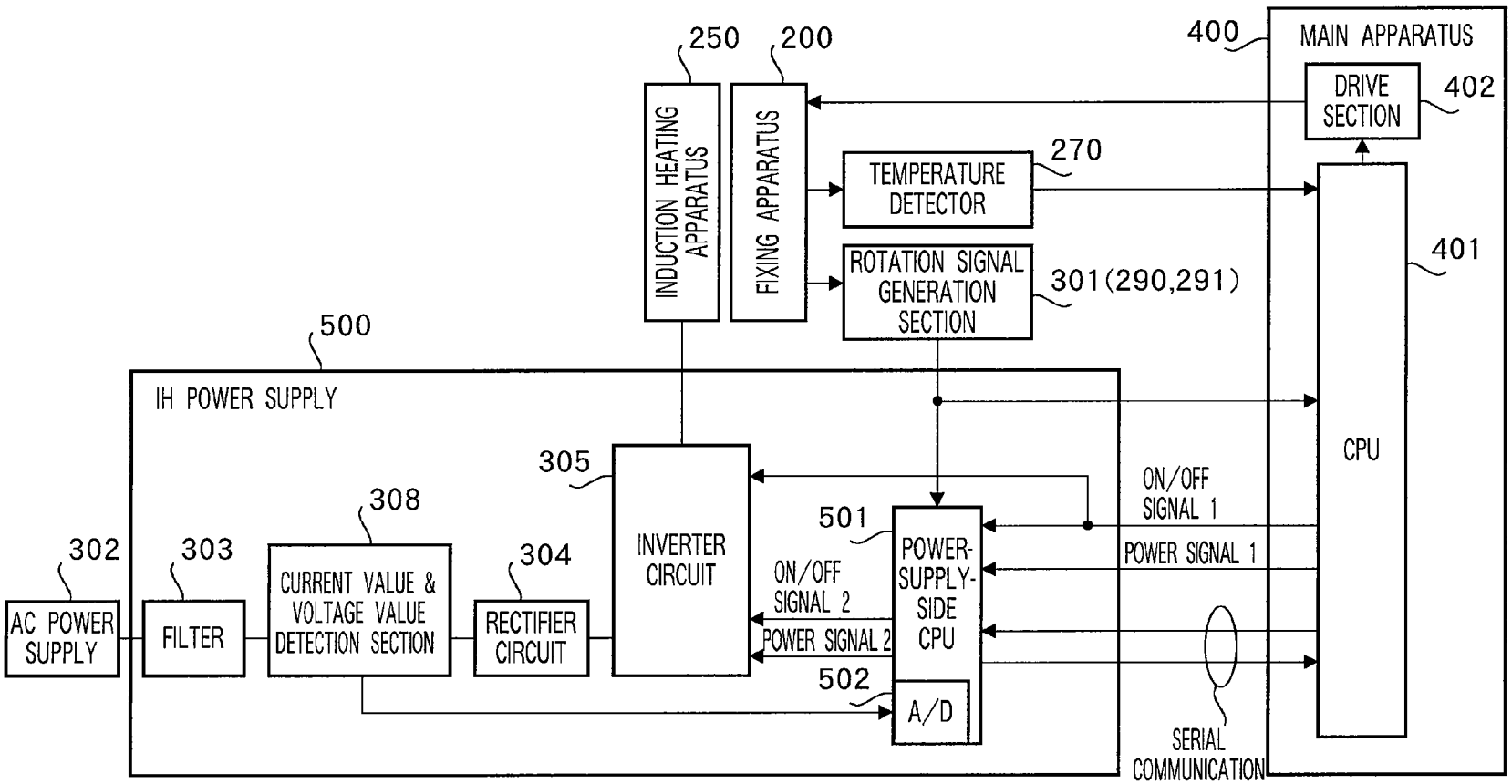
FIG. 7 is a circuit configuration diagram of an IH power supply in a fixing apparatus according to Embodiment 2 of the present invention.

FIG. 7 is a functional block diagram showing parts related to fixing apparatus 200, comprising an IH power supply 500 that controls the operation of induction heating apparatus 250 and a main apparatus 400 of an image forming apparatus. Parts having the same function as parts in above-described Embodiment 1 are assigned the same codes as in Embodiment 1.

IH power supply 500 basically has the same configuration as above-described IH power supply 300, except that rotation detection circuit 306 and oscillation stop circuit 307 are replaced by a power-supply-side CPU 501, but the control method is somewhat different, with CPU 401 on the main apparatus side indicating the desired power during a rise in temperature and during temperature regulation to power-supply-side CPU 501 by means of a power signal 1, and power-supply-side CPU 501 sending a power signal 2 to inverter circuit 305 so that the power indicated by CPU 401 is effected. That is to say, power-supply-side CPU 501 inputs an ON/OFF signal 2 and power signal 2 to inverter circuit 305 based on an ON/OFF signal 1 and power signal 1 sent from CPU 401 of main apparatus 400. Also, power-supply-side CPU 501 is configured so as to enable data exchange by serial communication with CPU 401 of main apparatus 400, and a detection signal output by detection section 308 is converted to a digital signal by an A/D converter 502 and sent to CPU 401 by serial communication. Furthermore, power-supply-side CPU 501 captures an output signal from rotation signal generation section 301 and performs determination of the rotation speed of fixing roller 210 (fixing belt 230), and in the case of a value at which oscillation of inverter circuit 305 should be stopped (a value less than or equal to a predetermined value), stops output of ON/OFF signal 2 and power signal 2 without regard to ON/OFF signal 1 and power signal 1 from CPU 401. Thus, when the rotation speed of fixing roller 210 (fixing belt 230) is at or below a predetermined value, power-supply-side CPU 501 acts to stop oscillation of inverter circuit 305 independently of a directive from CPU 401.

Since oscillation is controlled by having ON/OFF signal 1 and power signal 1 from CPU 401 relayed and supplied to inverter circuit 305 by power-supply-side CPU 501 installed on the IH power supply 500 side in this way, when the rotation speed of fixing roller 210 (fixing belt 230) detected from an output signal from rotation signal generation section 301 is at or below a predetermined value, oscillation of inverter circuit 305 is stopped by discontinuing output of ON/OFF signal 2 and power signal 2 even though CPU 401 is outputting ON/OFF signal 1 and power signal 1, enabling oscillation of inverter circuit 305 to be stopped dependably, and heat output to be suppressed dependably, even if CPU 401 fails.

The kind of function described above is only effectuated when the detection system that detects the rotation speed and power-supply-side CPU 501 are operating normally. It is therefore desirable for self-diagnosis of these functions to be carried out before operation of induction heating apparatus 250 and so forth is performed. In this embodiment, the configuration provides for CPU 401 to perform self-diagnosis each time power is turned on and/or the system is restored from the sleep state, and/or at regular intervals during standby.

Figure 8:
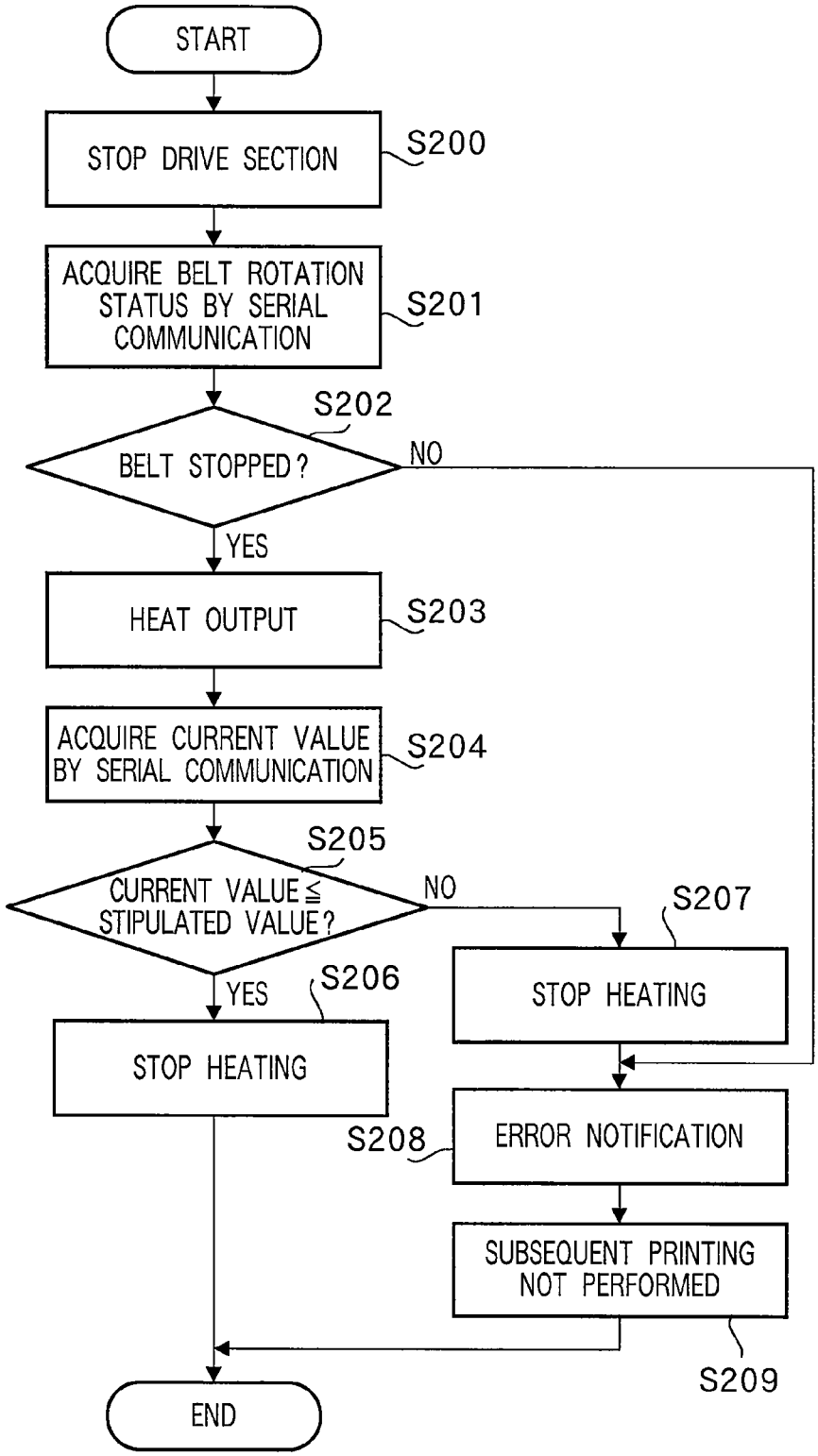
FIG. 8 is a flowchart for self-diagnosis of a fixing apparatus according to Embodiment 2 of the present invention.

FIG. 8 is a flowchart for self-diagnosis performed by CPU 401. This self-diagnosis is performed when power is turned on and/or at regular intervals during standby. When self-diagnosis is started, CPU 401 issues a stop command to drive section 402, and stops driving of pressure roller 240 (S200). After driving of pressure roller 240 is stopped and rotation of fixing roller 210 is stopped, a request is made to power-supply-side CPU 501 for fixing belt 230 rotation status information, and the rotation speed of fixing roller 210 (fixing belt 230) is acquired from power-supply-side CPU 501 (S201). The rotation status information request and rotation speed response between CPU 401 and power-supply-side CPU 501 are implemented by serial communication.

If CPU 401 detects from the rotation speed data that fixing belt 230 has stopped (S202: YES), CPU 401 outputs ON/OFF signal I and power signal 1 for heat output to power-supply-side CPU 501 (S203). Even though power-supply-side CPU 501 receives ON/OFF signal 1 and power signal 1, since the rotation speed of fixing roller 210 is at or below a predetermined value, power-supply-side CPU 501 does not send ON/OFF signal 2 or power signal 2 to inverter circuit 305. That is to say, inverter circuit 305 is controlled so as not to oscillate.

CPU 401 then acquires a detection signal (current value) from detection section 308 of IH power supply 500 (S204). Current value acquisition is performed by means of serial communication via power-supply-side CPU 501. CPU 401 compares the current value supplied to rectifier circuit 304 with a stipulated value (S205). As fixing belt 230 is currently stopped, if power-supply-side CPU 501 is operating normally, inverter circuit 305 should be being controlled so as not to oscillate, and therefore the current value supplied to rectifier circuit 304 should be less than or equal to the stipulated value. Therefore, if the current value is less than or equal to the stipulated value (S205: YES), CPU 401 determines that power-supply-side CPU 501 is operating normally, and executes heating stop processing (S206). To be specific, CPU 401 stops ON/OFF signal 1 and power signal 1 being output to power-supply-side CPU 501, and returns to the normal state.

However, if the current value exceeds the stipulated value (S205: NO), it can be determined that power-supply-side CPU 501 is not operating normally. In this case, CPU 401 executes heating stop processing (S207), and then executes error notification processing (S208). For example, a message indicating that a failure has occurred may be displayed on an operation panel (not shown) Then CPU 401 performs control so that no subsequent printing (heating) is performed (S209).

If CPU 401 determines in the processing in step S202 that stoppage of fixing belt 230 is not indicated (S202: NO), this means that power-supply-side CPU 501 has detected rotation even though rotation of pressure roller 240 and so forth has stopped, indicating that a failure has occurred in power-supply-side CPU 501 or rotation signal generation section 301. In this case, also, CPU 401 gives an error notification (S208) and performs control so that no subsequent printing (heating) is performed (S209).

By having CPU 401 perform diagnosis of power-supply-side CPU 501 in this way, a failure of power-supply-side CPU 501 can be detected in advance, and IH power supply 500 can be operated with the certainty that power-supply-side CPU 501 is normal, enabling the reliability of fixing apparatus 200 to be further increased.

Embodiment 3

Next, a fixing apparatus according to Embodiment 3 will be described. In Embodiment 3, a power suppression circuit is incorporated in the IH power supply, and a function is implemented by the CPU of the main apparatus that performs self-diagnosis to confirm that power input to a fixing apparatus that has a temperature maintaining mode in which fixing belt stoppage or rotation at or below a threshold value is set is suppressed to stipulated power or below. An image forming apparatus to which this fixing apparatus is applied may be the above-described apparatus shown in FIG. 1 and FIG. 2, or may be of another type.

Figure 9:
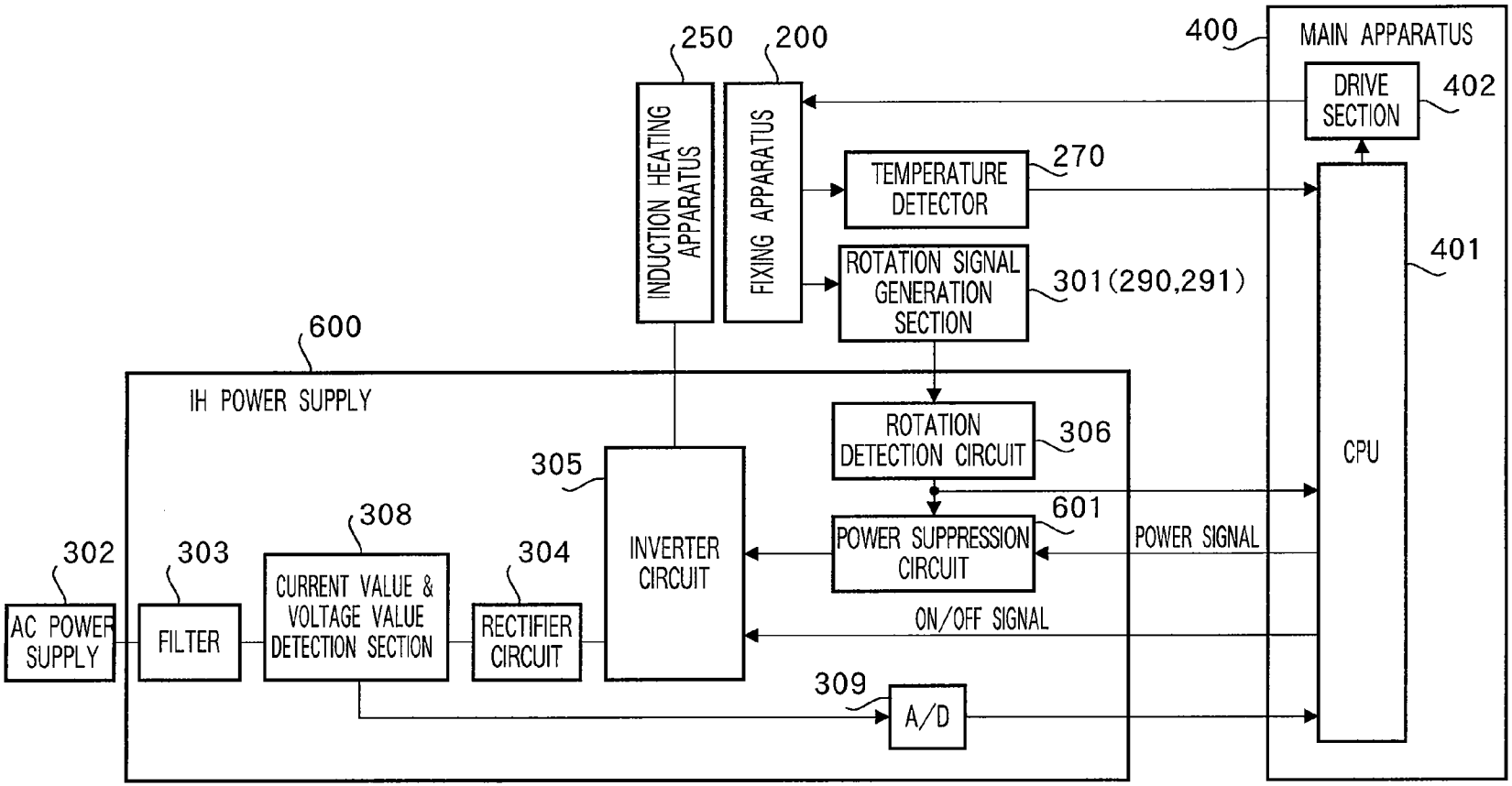
FIG. 9 is a circuit configuration diagram of an IH power supply in a fixing apparatus according to Embodiment 3 of the present invention.

FIG. 9 is a functional block diagram showing parts related to fixing apparatus 200, comprising an IH power supply 600 that controls the operation of induction heating apparatus 250 and a main apparatus 400 of an image forming apparatus. Parts having the same function as parts in above-described Embodiment 1 are assigned the same codes as in Embodiment 1.

IH power supply 600 basically has the same configuration as above-described IH power supply 300, except that oscillation stop circuit 307 is replaced by a power suppression circuit 601, but the control method is somewhat different, with CPU 401, when fixing apparatus 200 is in temperature maintaining mode, sending a power signal that inputs predetermined power to power suppression circuit 601 when fixing belt 230 stops or is rotating at or below a threshold value each time power is turned on or at regular intervals during standby, and performing self-diagnosis to confirm that the input power has been suppressed to the stipulated power or below. Also, during fixing belt 230 rotation when fixing apparatus 200 is not in the temperature maintaining mode, power suppression circuit 601 outputs an operating voltage of a level based on a power signal from CPU 401 to PWM circuit 332 in inverter circuit 305. Furthermore, when rotation of fixing belt 230 stops or is at or below a threshold value while fixing apparatus 200 is in the temperature maintaining mode, if the power signal from CPU 401 is at or below a stipulated level, power suppression circuit 601 outputs an operating voltage of a level based on that power signal to PWM circuit 332 in inverter circuit 305, and if the power signal is above the stipulated level, power suppression circuit 601 outputs an operating voltage of the stipulated level to PWM circuit 332 in inverter circuit 305. Thus, when fixing roller 210 (fixing belt 230) stops rotating, or its rotation speed is at or below a threshold value, while fixing apparatus 200 is in temperature maintaining mode, power suppression circuit 601 acts to stop oscillation of inverter circuit 305 independently of a directive from CPU 401.

Since, when fixing apparatus 200 is in temperature maintaining mode, oscillation is controlled by having a power signal from CPU 401 suppressed by power suppression circuit 601 installed on the IH power supply 600 side and supplied to inverter circuit 305 in this way, when the rotation speed of fixing roller 210 (fixing belt 230) detected from an output signal from rotation signal generation section 301 is zero or is at or below a predetermined value, oscillation of inverter circuit 305 is suppressed by suppressing the operating voltage output to a stipulated level even though CPU 401 is outputting a power signal of the stipulated level or above, enabling oscillation of inverter circuit 305 to be suppressed dependably, and heat output to be suppressed dependably, even if CPU 401 fails.

The kind of function described above is only effectuated when the detection system that detects the rotation speed and power suppression circuit 601 are operating normally. It is therefore desirable for self-diagnosis of these functions to be carried out before operation of induction heating apparatus 250 and so forth is performed. In this embodiment, the configuration provides for CPU 401 to perform self-diagnosis each time power is turned on, and/or at regular intervals during standby, when fixing apparatus 200 is in temperature maintaining mode.

Figure 10:
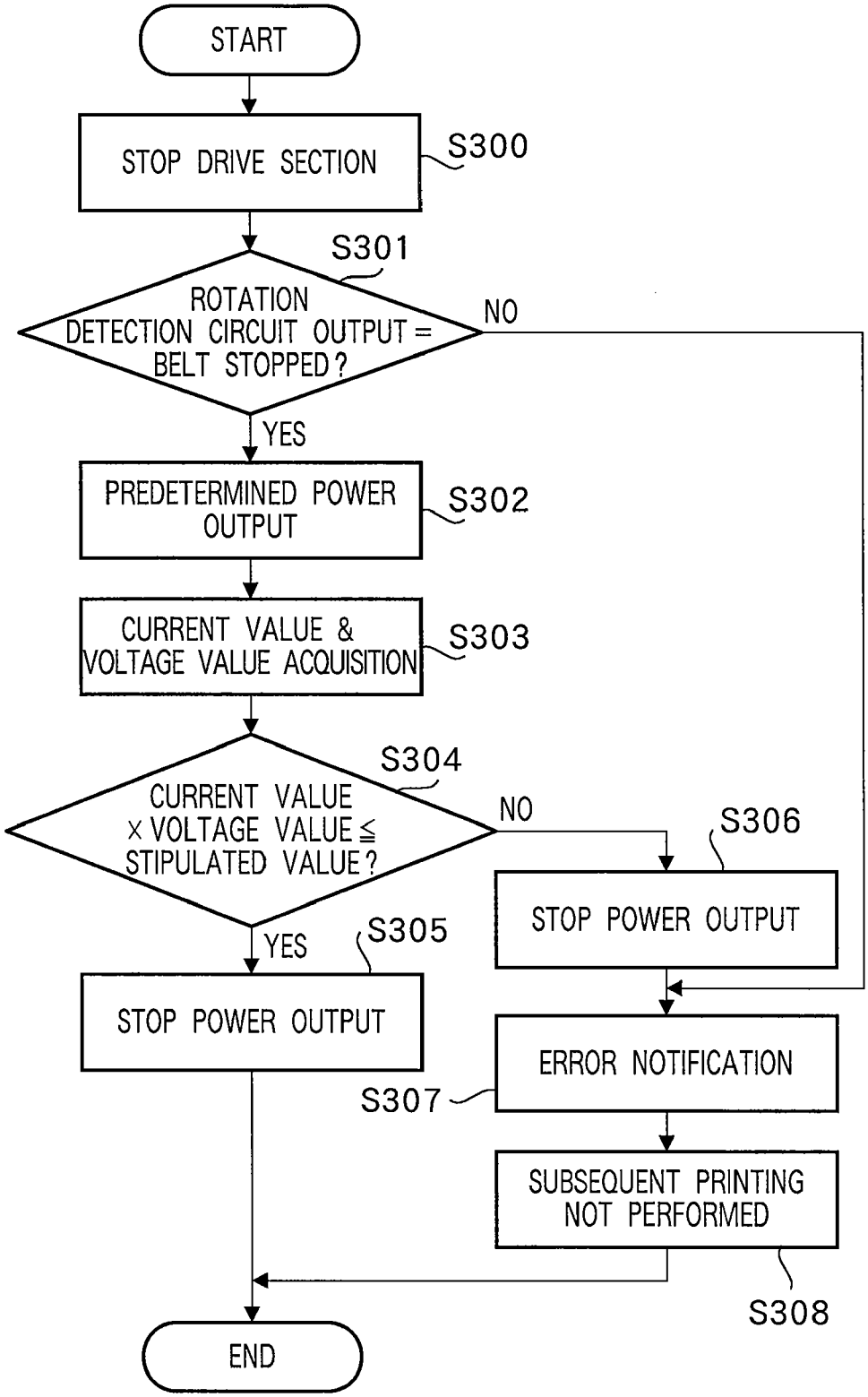
FIG. 10 is a flowchart for self-diagnosis of a fixing apparatus according to Embodiment 3 of the present invention.

FIG. 10 is a flowchart for self-diagnosis performed by CPU 401. This self-diagnosis is performed when power is turned on, and/or at regular intervals during standby, when fixing apparatus 200 is in temperature maintaining mode. When self-diagnosis is started, CPU 401 issues a stop command to drive section 402, and stops driving of pressure roller 240 (S300). After driving of pressure roller 240 is stopped and rotation of fixing roller 210 is stopped, a rotation detection signal output by rotation detection circuit 306 is captured, and it is determined whether or not fixing belt 230 (fixing roller 210) has stopped (S301). If the rotation detection signal is low-level, this indicates that the rotation speed of fixing roller 210 is at or below a predetermined value, but is here treated as indicating that rotation of fixing belt 230 has stopped. If rotation of fixing belt 230 is determined to have stopped (S301: YES), CPU 401 gives a directive for heat output to inverter circuit 305 by sending an ON/OFF signal to PWM circuit 332, and sending a power signal that inputs predetermined power to power suppression circuit 601 (S302). That is to say, a heating directive is given when a condition for not heating fixing belt 230 has been met.

CPU 401 captures a detection signal from detection section 308 (S303), and determines whether or not a power value obtained by multiplying together the current value and voltage value indicated by the detection signal (current value× voltage value) is less than or equal to the stipulated value (S304). If the power value is less than or equal to the stipulated value (S304: YES), this means that rotation detection circuit 306 and power suppression circuit 601 are operating normally. Therefore, in this case, CPU 401 determines that the results of the self-diagnosis are normal, and stops transmission of the ON/OFF signal and power signal being output to PWM circuit 332 and power suppression circuit 601 (S305).

On the other hand, if the power value is greater than the stipulated value (S304: NO), this means that power suppression circuit 601 is not operating normally and oscillation of inverter circuit 305 has not been suppressed. In this case, CPU 401 immediately stops heating by stopping transmission of the ON/OFF signal being output to PWM circuit 332 and the power signal being output to power suppression circuit 601 (S306), and executes error notification processing (S307). For example, a message indicating that a failure has occurred may be displayed on an operation panel (not shown). Then CPU 401 performs control so that no subsequent printing (heating) is performed (S308). Alternatively, a warning voice message may be issued.

If CPU 401 determines in the processing in step S301 that the rotation detection signal does not indicate that fixing belt 230 has stopped (S301: NO), this means that rotation detection circuit 306 has detected rotation even though rotation of pressure roller 240 and so forth has stopped, indicating that a failure has occurred in rotation detection circuit 306 or rotation signal generation section 301. In this case, also, CPU 401 gives an error notification (S307) and performs control so that no subsequent printing (heating) is performed (S308).

By having CPU 401 perform diagnosis of power suppression circuit 601 in this way when fixing apparatus 200 is in temperature maintaining mode, a failure of power suppression circuit 601 can be detected in advance, and IH power supply 600 can be operated with the certainty that power suppression circuit 601 is normal, enabling the reliability of fixing apparatus 200 to be further increased.

In this embodiment, a case has been described in which the power suppression circuit is provided on the IH power supply side, but the power suppression circuit may also be provided on the main apparatus side. Also, a power-supply-side processor may be provided on the IH power supply side, separately from the main apparatus, and made to perform the same operations as the power suppression circuit.

A first aspect of a fixing apparatus of the present invention has a configuration that includes: a rotating heating element that heat-fixes an unfixed image on a recording medium; a heating section that heats the rotating heating element; a power supply that supplies power to the heating section; and a self-diagnosis section that issues a directive for heating when a condition for not heating the rotating heating element has been met, and confirms that the rotating heating element is not heated.

According to this configuration, when a condition for not heating the rotating heating element has been met, a directive for heating is issued, and it is confirmed that the rotating heating element is not heated, enabling the safety of the apparatus to be confirmed before the apparatus is operated.

A second aspect of a fixing apparatus of the present invention has a configuration wherein, in the fixing apparatus described in the first aspect above, the power supply has: an inverter circuit that supplies a high-frequency alternating current to the heating section; and an oscillation stop circuit that stops oscillation of the inverter circuit when the rotating heating element stops or has a rotation speed less than or equal to a threshold value.

According to this configuration, the oscillation stop circuit can be installed in the power supply, not the main apparatus, making possible a design in which independence from the CPU of the main apparatus is increased compared with a case in which an oscillation stop function is provided on the main apparatus side.

A third aspect of a fixing apparatus of the present invention has a configuration wherein, in the fixing apparatus described in the second aspect above, there are provided: a signal generation section that outputs a phase signal corresponding to the rotation speed of the rotating heating element; and a rotation detection section that is provided independently of the processor, and detects from the phase signal that the rotating heating element has stopped rotating or has a rotation speed less than or equal to a threshold value.

According to this configuration, since the rotation detection section is provided independently of the processor, it is possible to determine whether or not a condition for stopping heating has been met without being affected by the reliability of the processor, enabling reliability to be improved.

A fourth aspect of a fixing apparatus of the present invention has a configuration wherein, in the fixing apparatus described in the first aspect above, the power supply has: an inverter circuit that supplies a high-frequency alternating current to the heating section; and a power-supply-side processor that controls oscillation of the inverter circuit in accordance with a control signal supplied from a processor, and when the rotating heating element stops or has a rotation speed less than or equal to a threshold value, stops oscillation of the inverter circuit without regard to the control signal.

According to this configuration, since a power-supply-side processor equivalent to an oscillation stop circuit is installed in the power supply, not the main apparatus, a design is possible in which independence from the CPU of the main apparatus is increased compared with a case in which an oscillation stop function is provided on the main apparatus side.

A fifth aspect of a fixing apparatus of the present invention has a configuration wherein, in the fixing apparatus described in the fourth aspect above, a signal generation section is provided that outputs a phase signal corresponding to the rotation speed of the rotating heating element; and the power-supply-side processor detects from the phase signal that the rotating heating element has stopped rotating or has a rotation speed less than or equal to a threshold value.

According to this configuration, since a rotation detection function is provided independently of the processor, it is possible to determine whether or not a condition for stopping heating has been met without being affected by the reliability of the processor, enabling reliability to be improved.

A sixth aspect of a fixing apparatus of the present invention has a configuration wherein, in the fixing apparatus described in the first aspect above, the self-diagnosis section executes self-diagnosis each time power is turned on and/or the system is restored from the sleep state, and/or at regular intervals during standby.

According to this configuration, self-diagnosis can be performed when the load on the CPU on the main apparatus side is light, enabling self-diagnosis to be performed without imposing a heavy load on the CPU.

A seventh aspect of a fixing apparatus of the present invention has a configuration wherein, in the fixing apparatus described in the first aspect above, the power supply has: an inverter circuit that supplies a high-frequency alternating current to the heating section; and a power suppression circuit that controls oscillation of the inverter circuit in accordance with a power control signal supplied from a processor, and when the rotating heating element stops or has a rotation speed less than or equal to a threshold value, suppresses oscillation of the inverter circuit without regard to the power control signal.

According to this configuration, since the power suppression circuit is provided independently of the processor, it is possible to determine whether or not a condition for suppressing heating has been met without being affected by the reliability of the processor, enabling reliability to be improved.

An eighth aspect of the present invention is an image forming apparatus that includes: an image forming section that forms an unfixed image on a recording medium; and a fixing apparatus that heat-fixes by means of a rotating heating element an unfixed image formed on the recording medium by the image forming section; wherein the fixing apparatus described in the first aspect above is used as the fixing apparatus.

The present application is based on Japanese Patent Application No. 2004-059754 filed on Mar. 3, 2004, entire content of which is expressly incorporated herein by reference.

INDUSTRIAL APPLICABILITY

The present invention performs self-diagnosis to confirm the normal operation of a mechanism that suppresses heating in the event of a condition for stopping heating in a fixing apparatus that can be applied to an image forming apparatus such as an electrophotographic copier, printer, or facsimile apparatus, and makes it possible to prevent an excessive rise in temperature of a rotating heating member dependably without the intermediation of a control circuit.

The invention claimed is:

1. A fixing apparatus comprising:

a heat producing element that performs heat-fixing of an unfixed image on a recording medium;

a heating section that is provided with power and that heats the heat producing element;

a power supply that receives an instruction from a control circuit located externally of the fixing apparatus and provides the power to the heating section;

a first detecting section that detects a state of the heat producing element heated by the heating section;

a power suppressing section that, when the first detecting section detects a state in which a condition for not performing heat-fixing for the heat producing element has been satisfied, suppresses providing the power from the power supply to the heating section, regardless of a content of the instruction; and a second detecting section that detects a state of the providing of the power to the heating section, wherein, when the first detecting section detects the state in which the condition for not performing heat-fixing for the heat producing element has been satisfied, if there is a state in which the providing of the power from the power supply to the heating section is suppressed, despite the power supply receiving the instruction for providing the power from the control circuit, the second detecting section detects the state and outputs a result of the detection to the control circuit located externally of the fixing apparatus.

2. The fixing apparatus according to claim 1, wherein the power supply comprises:

an inverter circuit that provides power with a high-frequency alternating current to the heating section; and an oscillation stop circuit that stops oscillation of the inverter circuit when the condition is satisfied.

3. The fixing apparatus according to claim 2, further comprising:

the heat producing element comprises a heat producing member that rotates; and the first detecting section comprises a signal generation section that detects a rotational state of the heat producing member and outputs a phase signal corresponding to a rotational speed of the heat producing member and detects, as a state of the heat producing member, from the phase signal, that the heat producing member has stopped rotating or has a rotational speed less than or equal to a threshold value.

4. The fixing apparatus according to claim 1, wherein the power supply comprises:

an inverter circuit that provides power with a high-frequency alternating current to the heating section; and a processor, wherein:

the processor controls oscillation of the inverter circuit; and the power suppression section suppresses providing the power regardless of the content of the instruction, by suppressing the oscillation of the inverter circuit regardless of the content of the instruction from the control circuit when the condition is satisfied.

5. The fixing apparatus according to claim 4, wherein:

the heat producing element comprises a heat producing member that rotates; and the first detecting section comprises a signal generation section that detects a rotational state of the heat producing member and outputs a phase signal corresponding to a rotational speed of the heat producing member and detects, as a rotational state of the heat producing member, from the phase signal, that the rotating heating element has stopped rotating or has a rotational speed less than or equal to a threshold value.

6. The fixing apparatus according to claim 1, wherein:

the power supply comprises an inverter circuit that provides power with a high-frequency alternating current to the heat producing element; and the power suppression section comprises a power suppression circuit that controls oscillation of the inverter circuit in accordance with a control signal supplied from the control circuit and suppresses oscillation of the inverter circuit regardless of the content of the instruction, when the first detecting section detects the state in which the condition for not performing heat-fixing for the heat producing element has been satisfied.

7. An image forming apparatus comprising:

an image forming section that forms an unfixed image on a recording medium; and a fixing apparatus that performs heat fixing for an unfixed image formed on the recording medium in the image forming section, wherein the fixing apparatus comprises:

a heating section that is provided with power and performs heating for a heat producing element that performs heat fixing of the unfixed image;

a power supply that receives an instruction from a control circuit and that provides the power to the heating section;

a first detecting section that detects a state of the heat producing element heated by the heating section;

a power suppressing section that, when the first detecting section detects a state in which a condition for not performing heat-fixing for the heat producing element has been satisfied, suppresses the providing of the power from the power supply to the heating section, regardless of a content of the instruction; and a second detecting section that detects a state of the providing of the power to the heating section, wherein, when the first detecting section detects the state in which the condition for not performing heat-fixing for the heat producing element has been satisfied, if there is a state in which the providing of the power from the power supply to the heating section is suppressed despite the power supply receiving the instruction for providing the power from the control circuit, the second detecting section detects the state and outputs a result of the detection to the control circuit located externally of the fixing apparatus.

8. The image forming apparatus according to claim 7, wherein, in the case where the state in which the condition for not performing heat-fixing for the heat producing element has been satisfied, is detected by the first detecting section of the image forming apparatus each time power is turned on and/or is restored from a sleep state, and/or at regular intervals during standby, the image forming apparatus issues an instruction for providing the power to the fixing apparatus, and makes the second detecting section detect that the heating section does not perform or suppresses the heating.

9. The fixing apparatus according to claim 7, wherein the power supply comprises:

an inverter circuit that provides power with a high-frequency alternating current to the heating section; and an oscillation stop circuit that stops oscillation of the inverter circuit when the condition is satisfied.

10. The fixing apparatus according to claim 9, further comprising:

the heat producing element comprises a heat producing member that rotates; and the first detecting section comprises a signal generation section that detects a rotational state of the heat producing member and outputs a phase signal corresponding to a rotational speed of the heat producing member and detects, as a state of the heat producing member, from the phase signal, that the heat producing member has stopped rotating or has rotational speed less than or equal to a threshold value.

11. The fixing apparatus according to claim 7, wherein the power supply comprises:

an inverter circuit that provides power with a high-frequency alternating current to the heating section; and a processor, wherein:

the processor controls oscillation of the inverter circuit; and the power suppression section suppresses providing the power regardless of the content of the instruction, by suppressing the oscillation of the inverter circuit regardless of the content of the instruction from the control circuit when the condition is satisfied.

12. The fixing apparatus according to claim 11, wherein:

the heat producing element comprises a heat producing member that rotates; and the first detecting section comprises a signal generation section that detects a rotational state of the heat producing member and outputs a phase signal corresponding to a rotational speed of the heat producing member and detects, as a rotational state of the heat producing member, from the phase signal, that the rotating heating element has stopped rotating or has a rotational speed less than or equal to a threshold value.

13. The fixing apparatus according to claim 7, wherein:

the power supply comprises an inverter circuit that provides power with a high-frequency alternating current to the heat producing element; and the power suppression section comprises a power suppression circuit that controls oscillation of the inverter circuit in accordance with a control signal supplied from a the control circuit, and suppresses oscillation of the inverter circuit regardless of the content of the instruction, when the first detecting section detects the state in which the condition for not performing heat-fixing for the heat producing element has been satisfied.

* * * * *